US005881406A

United States Patent [19]

Cobb

[11] Patent Number: 5,881,406

[45] Date of Patent: Mar. 16, 1999

[54] ADJUSTABLE BLANKET SUPPORT DEVICE

[76] Inventor: Kathleen S. Cobb, 2534 Prospect Dr., Upland, Calif. 91784

[21] Appl. No.: 31,476

[22] Filed: Feb. 26, 1998

[51] Int. Cl.[6] ..... A47C 21/02

[52] U.S. Cl. ..... 5/505.1; 5/503.1; 5/504.1

[58] Field of Search ..... 5/505.1, 503.1, 5/504.1, 426, 404, 488, 658

[56] References Cited

U.S. PATENT DOCUMENTS

| | | | |
|---|---|---|---|
| 2,618,789 | 11/1952 | Kane | 5/505.1 |
| 2,642,589 | 6/1953 | Cobb | 5/505.1 |
| 2,750,604 | 6/1956 | Gold | 5/505.1 |

FOREIGN PATENT DOCUMENTS

| | | | |
|---|---|---|---|
| 000618175 | 12/1935 | Germany | 5/504.1 |
| 001238500 | 7/1971 | United Kingdom | 5/504.1 |

*Primary Examiner*—Brian K. Green
*Assistant Examiner*—James M. Hewitt

[57] ABSTRACT

A new adjustable blanket support device for raising the cover sheets on a bed, especially from the foot of the bed, to keep the cover sheets above the feet of a person lying on the bed under the sheets. The device includes a base member having an elongate lower cross bar and a pair of spaced apart elongate lower arms extending from the lower cross bar. Each of the lower arms terminates in a terminal end and has a bore extending from the terminal end towards the lower cross bar. A mounting member with an elongate insertion cross portion and a pair of spaced apart elongate arm portions extending from the insertion cross portion. Each of the arm portions of the mounting member terminates at a terminus which are each pivotally coupled to an associated lower arm of the base member to permit pivoting of the mounting member between a raised position and a lowered position. A sheet raising member has an elongate raising cross beam and a pair of spaced apart elongate legs depending from the raising cross beam. Each of the legs terminates at an end that are each inserted into the bore of the associated lower arm of the base member. The legs of the sheet raising member are movable within the bore of their respective the lower arm of the base member such that the sheet raising member is positionable between an extended position and a retracted position. A raising device is provided on the lower cross bar for moving the sheet raising member between the retracted position and the extended position.

13 Claims, 3 Drawing Sheets

ADJUSTABLE BLANKET SUPPORT DEVICE

BACKGROUND OF THE INVENTION

1. Field of the Invention

The present invention relates to devices for raising the covers above a bed and more particularly pertains to a new adjustable blanket support device for raising the cover sheets on a bed, especially from the foot of the bed, to keep the cover sheets above the feet of a person lying on the bed under the sheets.

2. Description of the Prior Art

The use of devices for raising the covers above a bed is known in the prior art. More specifically, devices for raising the covers above a bed heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for raising the covers above a bed include U. S. Pat. No. 4,214,327; U.S. Pat. No. 2,210,255; U.S. Pat. No. 4,975,997; U.S. Pat. No. 5,203,042; U.S. Pat. No. 3,173,158; PCT Patent No. WO 87/04066-Inventors: Joly et al.; and EPO Patent No. EP 0 552 502 A2-Inventor: Kötter.

While these devices fulfill their respective, particular objectives and requirements, the aforementioned patents do not disclose a new adjustable blanket support device. The inventive device includes a base member having an elongate lower cross bar and a pair of spaced apart elongate lower arms extending from the lower cross bar. Each of the lower arms terminates in a terminal end and has a bore extending from the terminal end towards the lower cross bar. A mounting member with an elongate insertion cross portion and a pair of spaced apart elongate arm portions extending from the insertion cross portion. Each of the arm portions of the mounting member terminates at a terminus which are each pivotally coupled to an associated lower arm of the base member to permit pivoting of the mounting member between a raised position and a lowered position. A sheet raising member has an elongate raising cross beam and a pair of spaced apart elongate legs depending from the raising cross beam. Each of the legs terminates at an end that are each inserted into the bore of the associated lower arm of the base member. The legs of the sheet raising member are movable within the bore of their respective the lower arm of the base member such that the sheet raising member is positionable between an extended position and a retracted position. A raising device for moving the sheet raising member between the retracted position and the extended position is provided on the lower cross bar and includes a remote controller for controlling the positioning of the sheet raising member between the extended position and the retracted position.

In these respects, the adjustable blanket support device according to the present invention substantially departs from the conventional concepts and designs of the prior art, and in so doing provides an apparatus primarily developed for the purpose of raising the cover sheets on a bed, especially from the foot of the bed, to keep the cover sheets above the feet of a person lying on the bed under the sheets.

SUMMARY OF THE INVENTION

In view of the foregoing disadvantages inherent in the known types of devices for raising the covers above a bed now present in the prior art, the present invention provides a new adjustable blanket support device construction wherein the same can be utilized for raising the cover sheets on a bed, especially from the foot of the bed, to keep the cover sheets above the feet of a person lying on the bed under the sheets.

The general purpose of the present invention, which will be described subsequently in greater detail, is to provide a new adjustable blanket support device apparatus and method which has many of the advantages of the devices for raising the covers above a bed mentioned heretofore and many novel features that result in a new adjustable blanket support device which is not anticipated, rendered obvious, suggested, or even implied by any of the prior art devices for raising the covers above a bed, either alone or in any combination thereof.

To attain this, the present invention generally comprises a base member having an elongate lower cross bar and a pair of spaced apart elongate lower arms extending from the lower cross bar. Each of the lower arms terminates in a terminal end and has a bore extending from the terminal end towards the lower cross bar. A mounting member with an elongate insertion cross portion and a pair of spaced apart elongate arm portions extending from the insertion cross portion. Each of the arm portions of the mounting member terminates at a terminus which are each pivotally coupled to an associated lower arm of the base member to permit pivoting of the mounting member between a raised position and a lowered position. A sheet raising member has an elongate raising cross beam and a pair of spaced apart elongate legs depending from the raising cross beam. Each of the legs terminates at an end that are each inserted into the bore of the associated lower arm of the base member. The legs of the sheet raising member are movable within the bore of their respective the lower arm of the base member such that the sheet raising member is positionable between an extended position and a retracted position. A raising device for moving the sheet raising member between the retracted position and the extended position is provided on the lower cross bar and includes a remote controller for controlling the positioning of the sheet raising member between the extended position and the retracted position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable blanket support device apparatus and method which has many of the advantages of the devices for raising the covers above a bed mentioned heretofore and many novel features that result in a new adjustable blanket support device which is not anticipated, rendered obvious, suggested, or even implied by any of the prior art devices for raising the covers above a bed, either alone or in any combination thereof.

It is another object of the present invention to provide a new adjustable blanket support device which may be easily and efficiently manufactured and marketed.

It is a further object of the present invention to provide a new adjustable blanket support device which is of a durable and reliable construction.

An even further object of the present invention is to provide a new adjustable blanket support device which is susceptible of a low cost of manufacture with regard to both materials and labor, and which accordingly is then susceptible of low prices of sale to the consuming public, thereby making such adjustable blanket support device economically available to the buying public.

Still yet another object of the present invention is to provide a new adjustable blanket support device which provides in the apparatuses and methods of the prior art some of the advantages thereof, while simultaneously overcoming some of the disadvantages normally associated therewith.

Still another object of the present invention is to provide a new adjustable blanket support device for raising the cover sheets on a bed, especially from the foot of the bed, to keep the cover sheets above the feet of a person lying on the bed under the sheets.

Yet another object of the present invention is to provide a new adjustable blanket support device which includes a base member having an elongate lower cross bar and a pair of spaced apart elongate lower arms extending from the lower cross bar. Each of the lower arms terminates in a terminal end and has a bore extending from the terminal end towards the lower cross bar. A mounting member with an elongate insertion cross portion and a pair of spaced apart elongate arm portions extending from the insertion cross portion. Each of the arm portions of the mounting member terminates at a terminus which are each pivotally coupled to an associated lower arm of the base member to permit pivoting of the mounting member between a raised position and a lowered position. A sheet raising member has an elongate raising cross beam and a pair of spaced apart elongate legs depending from the raising cross beam. Each of the legs terminates at an end that are each inserted into the bore of the associated lower arm of the base member. The legs of the sheet raising member are movable within the bore of their respective the lower arm of the base member such that the sheet raising member is positionable between an extended position and a retracted position. A raising device for moving the sheet raising member between the retracted position and the extended position is provided on the lower cross bar and includes a remote controller for controlling the positioning of the sheet raising member between the extended position and the retracted position.

Still yet another object of the present invention is to provide a new adjustable blanket support device that can be remotely controlled so that a person lying in a bed can remotely raise the sheets on a bed off of their feet.

Even still another object of the present invention is to provide a new adjustable blanket support device that helps keep the weight of the covers of a bed off of the feet of a person lying in the bed which is especially convenient for people recovering from foot surgery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
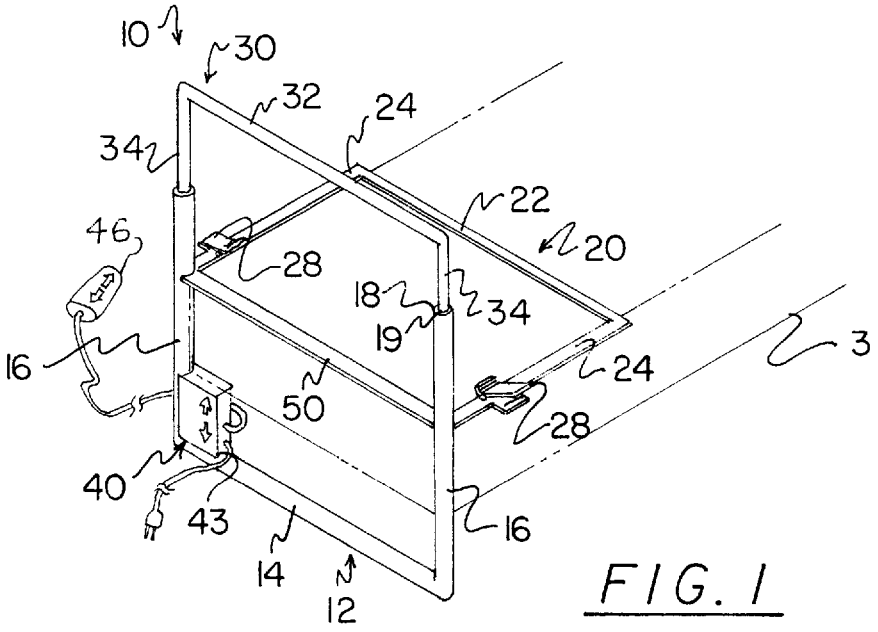
FIG. 1 is a schematic perspective view of a new adjustable blanket support device with the mounting member in the raised position according to the present invention.

With reference now to the drawings, and in particular to FIGS. 1 through 5 thereof, a new adjustable blanket support device embodying the principles and concepts of the present invention and generally designated by the reference numeral 10 will be described.

As best illustrated in FIGS. 1 through 5, the adjustable blanket support device 10 generally comprises a base member 12 having an elongate lower cross bar 14 and a pair of spaced apart elongate lower arms 16 extending from the lower cross bar 14. Each of the lower arms 16 terminates in a terminal end 18 and has a bore 19 extending from the terminal end 18 towards the lower cross bar 14. A mounting member 20 with an elongate insertion cross portion 22 and a pair of spaced apart elongate arm portions 24 extending from the insertion cross portion 22. Each of the arm portions 24 of the mounting member 20 terminates at a terminus 26 which are each pivotally coupled to an associated lower arm 16 of the base member 12 to permit pivoting of the mounting member 20 between a raised position and a lowered position. A sheet raising member 30 has an elongate raising cross beam 32 and a pair of spaced apart elongate legs 34 depending from the raising cross beam 32. Each of the legs 34 terminates at an end that are each inserted into the bore 19 of the associated lower arm 16 of the base member 12. The legs 34 of the sheet raising member 30 are movable within the bore 19 of their respective the lower arm 16 of the base member 12 such that the sheet raising member 30 is positionable between an extended position and a retracted position. A raising device for moving the sheet raising member between the retracted position and the extended position is provided on the lower cross bar 14 and includes a remote controller 46 for controlling the positioning of the sheet raising member 30 between the extended position and the retracted position.

Figure 2:
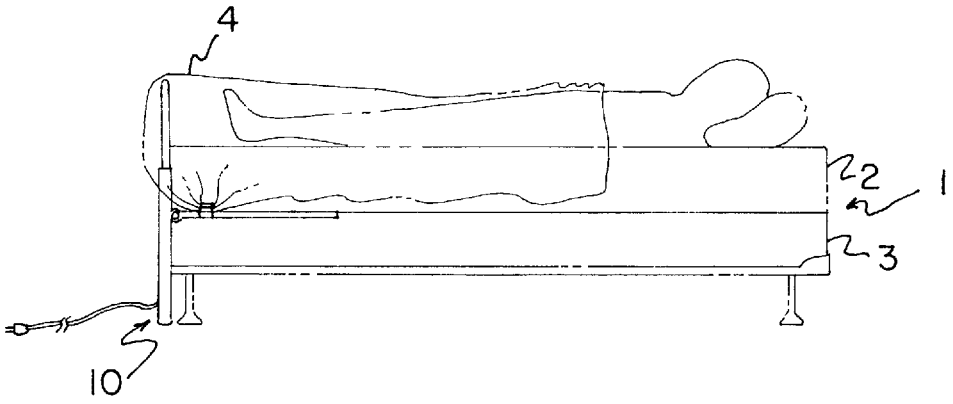
FIG. 2 is a schematic side view of the present invention in use raising the sheets of a bed above the feet of a person lying on the bed.

As illustrated in FIG. 2, the blanket support device 10 is designed for use in lifting sheets and blankets 4 above a bed 1 that has a mattress 2 resting on a support base 3 such as a box spring. In closer detail, the base member 12 is generally U-shaped and has an elongate lower cross bar 14 and a pair of spaced apart elongate lower arms 16 extending from the lower cross bar 14. The lower cross bar 14 and the lower arms 16 of the base member 12 are preferably generally cylindrical and have a generally circular cross section. The lower arms 16 of the base member 12 are substantially parallel to one another and are extended substantially perpendicular to the lower cross bar 14. Each of the lower arms 16 terminates at a terminal end 18 with each of the lower arms 16 having a generally cylindrical bore 19 extending from the terminal end 18 of its respective the lower arm 16 towards the lower cross bar 14 of the base member 12. Optionally, an elongate support bar 50 may be extended between the terminal ends 18 of the lower arms 16 of the base member 12. Preferably, the support bar 50 has a generally rectangular cross section. The support bar 50 is designed for providing addition structural strength to the base member 12.

Figure 4:
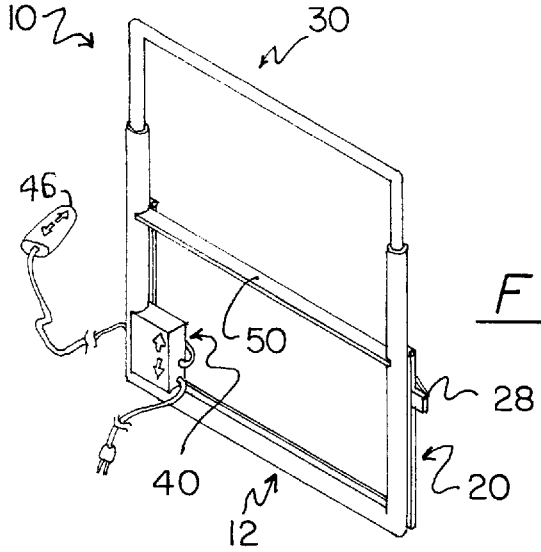
FIG. 4 is a schematic perspective view of the present invention with the mounting member in the lowered position.
Figure 5:
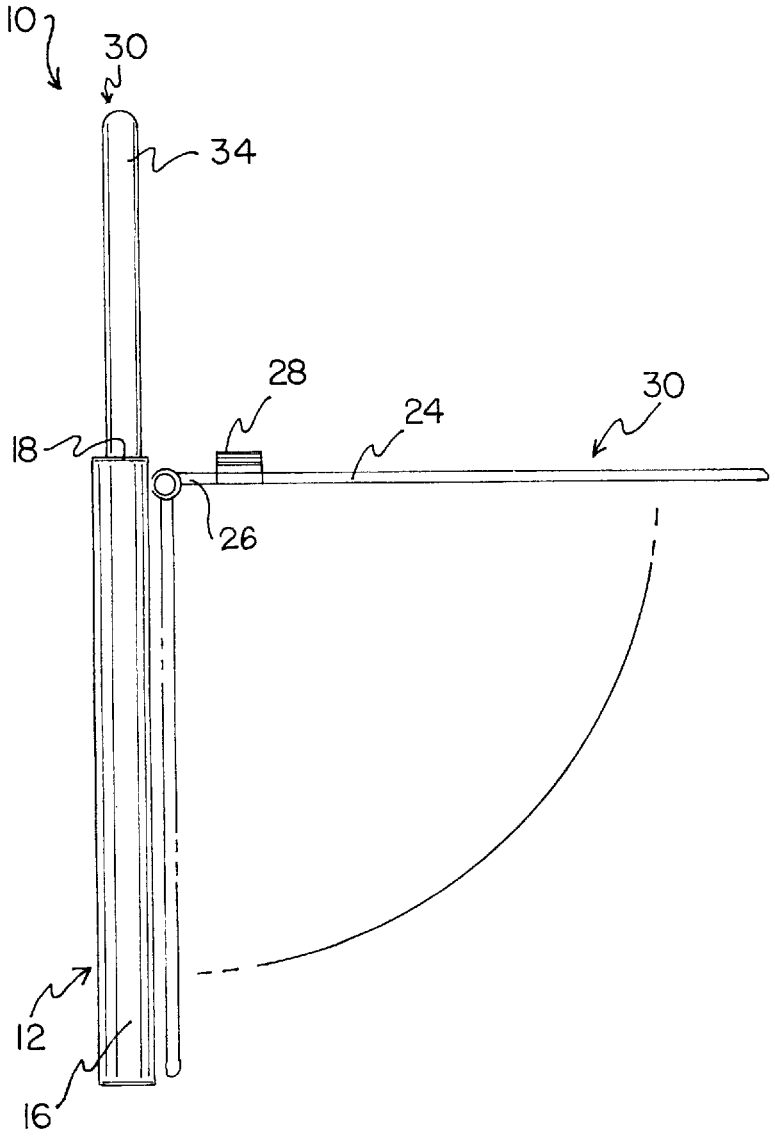
FIG. 5 is a schematic side view of the present invention.

The mounting member 20 is generally U-shaped and has an elongate insertion cross portion 22 and a pair of spaced apart elongate arm portions 24 extending from the insertion cross portion 22. The arm portions 24 are extended substantially perpendicular to the insertion cross portion 22. Ideally, the arm portions 24 and the insertion cross portion 22 of the mounting member 20 have a generally rectangular cross section. Each of the arm portions 24 terminates at a terminus 26 with the terminus 26 of one of the arm portions 24 being pivotally coupled to one of the lower arms 16 of the base member 12 and the terminus 26 of another of the arm portions 24 being pivotally coupled to another of the lower arms 16 of the base member 12. Preferably, the terminus 26 of each of the arm portions 24 is positioned towards the terminal end 18 of its respective the lower arm 16 of the base member 12 as illustrated in the Figures. The mounting member 20 is pivotable between a raised position and a lowered position. As best illustrated in FIG. 4, the lengths of the arm portions 24 of the mounting member 20 are generally parallel with the lengths of the lower arms 16 of the base member 12 when the mounting member 20 is positioned at the lowered position. This arrangement is ideally for convenient storage of the invention. With reference to FIG. 1, the lengths of the arm portions 24 of the mounting member 20 are generally perpendicular with the lengths of the lower arms 16 of the base member 12 when the mounting member 20 is positioned at the raised position. As shown in FIG. 2, the mounting member 20 is designed for inserting between the mattress 2 and support structure 3 of a bed 1 when positioned at the raised position to mount the blanket support device 10 to the bed 1. Ideally, each of the arm portions 24 of the mounting member 20 has a sheet clip member 28 coupled thereto for releasably holding a portion of a sheet 4 to the arm portions 24 of the mounting member 20. As illustrated in FIG. 2, the sheet clip members 28 help hold the ends of the sheets 4 when the sheets are tucked in underneath the mattress 2 of the bed.

The sheet raising member 30 is generally an inverted U-shape and has an elongate raising cross beam 32 and a pair of spaced apart elongate legs 34 depending from the raising cross beam 32. The raising cross beam 32 is designed for resting a portion of a sheet 4 thereon. The legs 34 are extended substantially perpendicular to the raising cross beam 32 with each of the legs 34 terminating at an end. The end of one of the legs 34 of the sheet raising member 30 is inserted into the bore 19 of one of the lower arms 16 of the base member 12 while the end of another of the legs 34 is inserted into the bore 19 of another of the lower arms 16 of the base member 12. The legs 34 of the sheet raising member 30 are movable within the bore 19 of their respective the lower arm 16 of the base member 12 such that the sheet raising member 30 is positionable between an extended position and a retracted position. When sheet raising member 30 is positioned at the retracted position, the raising cross beam 32 is positioned adjacent the terminal ends 18 of the lower arms 16 of the base member 12. When the sheet raising member 30 is positioned towards the extended position, the raising cross beam 32 is extended away from the terminal ends 18 of the lower arms 16 of the base member 12. This arrangement permits the raising and lowering of sheets resting on the resting cross beam 32 so that the sheets 4 may be lifted above the feet of a person lying in the bed 1.

The raising device 40 is designed for raising and lowering the sheet raising member 30 between the retracted position and the extended position so that the sheets 4 resting on the resting cross beam 32 may be raised and lowered. The raising device 40 includes a motor 42 which is provided within a housing 43 on the lower cross bar 14 of the base member 12 and preferably adjacent one of the lower arms 16 of the base member 12. The motor 42 may be operatively connectable to a power source by an electric cord to power the motor 42. The motor 42 is operationally connected to the leg 34 of the sheet raising member 30 inserted within the bore 19 of the adjacent lower arm 16 of the base member 12 such that the motor 42 may move the leg 34 of the sheet raising member 30 within the bore 19 of the lower arm 16 of the base member 12. This permits moving of the sheet raising member 30 between the extended position and the retracted position.

Figure 3:
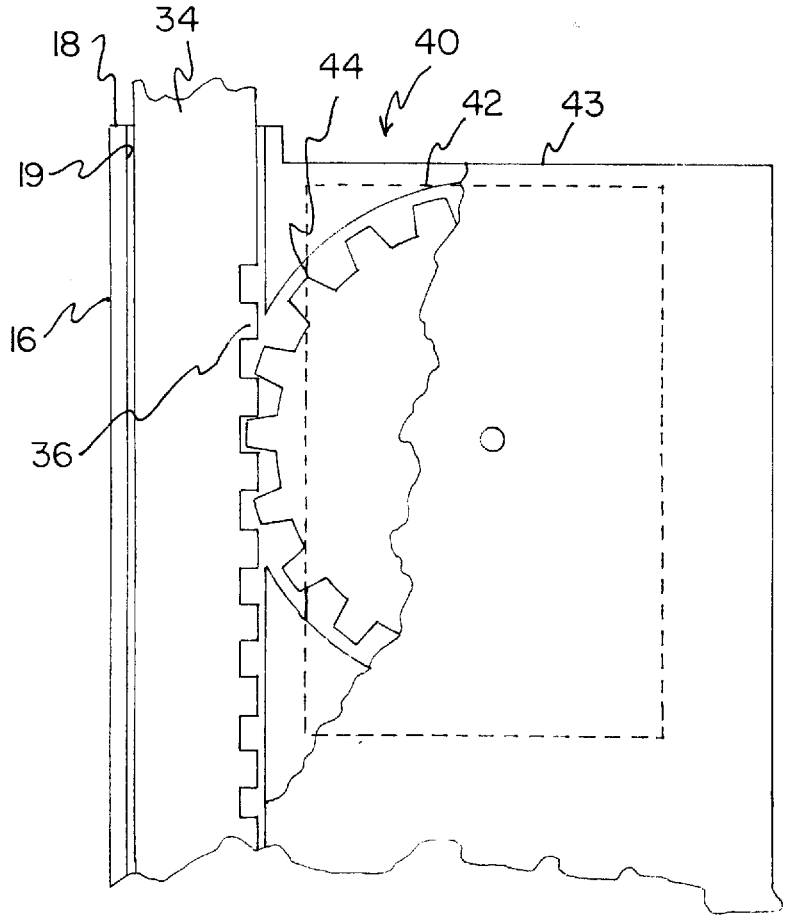
FIG. 3 is a schematic breakaway side view of the raising device of the present invention.

With reference to FIG. 3, the leg 34 of sheet raising member 30 operationally connected to the motor 42 has a plurality of teeth 36 while the motor 42 has a gear 44 rotatably connected thereto which engages the teeth 36 of the leg 34 of the sheet raising member 30 to permit moving of the leg 34 of the sheet raising member 30 within the bore 19. Preferably, the raising device 40 includes a remote controller 46 operationally connected to the motor 42 for controlling the positioning of the sheet raising member 30 between the extended position and the retracted position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blanket support device for lifting sheets and blankets above a bed having a mattress resting on a support base, said blanket support device comprising:

a base member having an elongate lower cross bar and a pair of spaced apart elongate lower arms extending therefrom;

each of said lower arms terminating in a terminal end, each of said lower arms of said base member having a bore extending from said terminal end of the respective lower arm of said base member towards said lower cross bar of said base member;

a mounting member having an elongate insertion cross portion and a pair of spaced apart elongate arm portions being extended from said insertion cross portion of said mounting member, each of said arm portions of said mounting member terminating at a terminus, said terminus of one of said arm portions being pivotally coupled to one of said lower arms of said base member, said terminus of the other of said arm portions being pivotally coupled to another of said lower arms of said base member, said terminus of each of said arm portions of said mounting member being positioned towards said terminal end of the respective lower arm of said base member;

said mounting member being pivotable between a raised position and a lowered position;

a sheet raising member having an elongate raising cross beam and a pair of spaced apart elongate legs being depended from said raising cross beam, each of said legs terminating at an end, said end of one of said legs of said sheet raising member being inserted into said bore of one of said lower arms of said base member, said end of the other of said legs of said sheet raising member being inserted into said bore of another of said lower arms of said base member;

said legs of said sheet raising member being movable within said bore of a respective said lower arm of said base member such that said sheet raising member is positionable between an extended position and a retracted position;

a raising device for moving said sheet raising member between said retracted position and said extended position; and wherein said raising device includes a remote controller for controlling the positioning of said sheet raising member between said extended position and said retracted position.

2. The device of claim 1, wherein said base member is generally U-shaped, wherein mounting member is generally U-shaped, and wherein sheet raising member is generally an inverted U-shape.

3. The device of claim 1, wherein said lower cross bar and said lower arms of said base member are generally cylindrical and having a generally circular cross section, and wherein said bores of said lower arms are generally cylindrical.

4. The device of claim 1, wherein said lower arms of said base member are substantially parallel to one another, and wherein said lower arms of said base member are extended substantially perpendicular to said lower cross bar of said base member.

5. The device of claim 1, further comprising an elongate support bar being extended between said terminal ends of said lower arms of said base member.

6. The device of claim 5, wherein said support bar has a generally rectangular cross section.

7. The device of claim 1, wherein said arm portions of said mounting member are extended substantially perpendicular to insertion cross portion of said mounting member.

8. The device of claim 1, wherein said arm portions of said mounting member are generally parallel with said lower arms of said base member when said mounting member is positioned at said lowered position, and wherein said arm portions of said mounting member are generally perpendicular with said lower arms of said base member when said mounting member is positioned at said raised position.

9. The device of claim 1, wherein said legs of said sheet raising member are extended substantially perpendicular to said raising cross beam of said sheet raising member.

10. The device of claim 1, wherein said raising cross beam is positioned adjacent said terminal ends of said lower arms of said base member when said sheet raising member is positioned at said retracted position.

11. The device of claim 1, wherein said raising device includes a motor being provided on said lower cross bar of said base member and adjacent one of said lower arms of said base member, said motor being operatively connectable to a power source, said motor being operationally connected to a first leg of said sheet raising member inserted within said bore of said adjacent lower arm of said base member such that said motor may move said first leg of said sheet raising member within said bore of said lower arm of said base member so that said sheet raising member may be moved between said extended position and said retracted position, and wherein said remote controller is operationally connected to said motor of said raising device.

12. The device of claim 11, wherein said first leg of sheet raising member operationally connected to said motor has a plurality of teeth, wherein said motor has a gear rotatably connected thereto, said gear engaging said teeth of said first leg of said sheet raising member to permit moving of said first leg of said sheet raising member within said bore of said lower arm positioned adjacent said motor.

13. A blanket support device for lifting sheets and blankets above a bed having a mattress resting on a support base, said blanket support device comprising:

a base member being generally U-shaped and having an elongate lower cross bar and a pair of spaced apart elongate lower arms extending therefrom, said lower cross bar and said lower arms of said base member being generally cylindrical and having a generally circular cross section;

said lower arms of said base member being substantially parallel to one another, said lower arms of said base member being extended substantially perpendicular to said lower cross bar of said base member, each of said lower arms terminating in a terminal end, each of said lower arms of said base member having a generally cylindrical bore extending from said terminal end of the respective lower arm of said base member towards said lower cross bar of said base member;

an elongate support bar being extended between said terminal ends of said lower arms of said base member, said support bar having a generally rectangular cross section, said support bar being for providing additional structural strength to said base member;

a mounting member being generally U-shaped and having an elongate insertion cross portion and a pair of spaced apart elongate arm portions being extended from said insertion cross portion of said mounting member, said arm portions being extended substantially perpendicular to insertion cross portion, said arm portions and said insertion cross portion of said member having a generally rectangular cross section, each of said arm portions of said mounting member terminating at a terminus, said terminus of one of said arm portions being pivotally coupled to one of said lower arms of said base member, said terminus of the other of said arm portions being pivotally coupled to another of said lower arms of said base member, said terminus of each of said arm portions of said mounting member being positioned towards said terminal end of the respective lower arm of said base member;

each of said arm portions of said mounting member having a sheet clip member coupled thereto for releasably holding a portion of a sheet to said arm portions of said mounting member;

said mounting member being pivotable between a raised position and a lowered position, wherein said arm portions of said mounting member are generally parallel with said lower arms of said base member when said mounting member is positioned at said lowered position, wherein said arm portions of said mounting member are generally perpendicular with said lower arms of said base member when said mounting member is positioned at said raised position, said mounting member being for inserting between a mattress of a base and a support structure of a bed when positioned at said raised position to mount said blanket support device to a bed;

a sheet raising member being generally an inverted U-shape and having an elongate raising cross beam and a pair of spaced apart elongate legs being depended from said raising cross beam, said legs being extended substantially perpendicular to said raising cross beam, each of said legs terminating at an end, said end of one of said legs of said sheet raising member being inserted into said bore of one of said lower arms of said base member, said end of the other of said legs of said sheet raising member being inserted into said bore of another of said lower arms of said base member;

said legs of said sheet raising member being movable within said bore of their respective said lower arm of said base member such that said sheet raising member is positionable between an extended position and a retracted position, wherein said raising cross beam is positioned adjacent said terminal ends of said lower arms of said base member when said sheet raising member is positioned at said retracted position, wherein said raising cross beam is extended away from said terminal ends of said lower arms of said base member when said sheet raising member is positioned towards said extended position;

a raising device for moving said sheet raising member between said retracted position and said extended position, said raising device including a motor being provided on said lower cross bar of said base member and adjacent one of said lower arms of said base member, said motor being operatively connectable to a power source, said motor being operationally connected to a first leg of said sheet raising member inserted within said bore of said adjacent lower arm of said base member such that said motor may move said first leg of said sheet raising member within said bore of said lower arm of said base member so that said sheet raising member may be moved between said extended position and said retracted position;

wherein said first leg of sheet raising member operationally connected to said motor having a plurality of teeth, wherein said motor has a gear rotatably connected thereto, said gear engaging said teeth of said first leg of said sheet raising member to permit moving of said first leg of said sheet raising member within said bore of said lower arm positioned adjacent said motor; and wherein said raising device includes a remote controller for controlling the positioning of said sheet raising member between said extended position and said retracted position, said remote controller being operationally connected to said motor of said raising device.

* * * * *